US006981528B2

(12) United States Patent
Bartholomew

(10) Patent No.: US 6,981,528 B2
(45) Date of Patent: Jan. 3, 2006

(54) ANTI-JAM TENSIONING GEAR MECHANISM FOR AUTOMATIC TIE TOOL HEAD

(75) Inventor: Paul Bartholomew, Somerville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 141 days.

(21) Appl. No.: 10/680,891

(22) Filed: Oct. 7, 2003

(65) Prior Publication Data

US 2005/0072486 A1 Apr. 7, 2005

(51) Int. Cl.
*B21F 9/02* (2006.01)

(52) U.S. Cl. ..... 140/93.2; 140/123.6

(58) Field of Classification Search ..... 140/93.2, 140/93 A, 123.6, 152, 123.5; 100/33 PB, 100/32, 33 R See application file for complete search history.

(56) References Cited

U.S. PATENT DOCUMENTS

| | | | | |
|---|---|---|---|---|
| 2,638,314 A | | 5/1953 | McFerren et al. | |
| 3,327,619 A | | 6/1967 | Sellman | |
| 3,700,010 A | | 10/1972 | Bartilson et al. | |
| 3,746,055 A | * | 7/1973 | Farkas et al. | 140/93.2 |
| 3,946,769 A | | 3/1976 | Caveney et al. | |
| 4,498,506 A | | 2/1985 | Moody et al. | |
| 4,862,928 A | * | 9/1989 | Caveney et al. | 140/93.2 |
| 5,205,328 A | | 4/1993 | Johnson et al. | |
| 5,595,220 A | | 1/1997 | Leban et al. | |
| 6,202,706 B1 | | 3/2001 | Leban | |
| 6,279,620 B1 | | 8/2001 | Eason et al. | |
| 6,367,376 B1 | * | 4/2002 | Bobren | 100/8 |

* cited by examiner

*Primary Examiner*—Derris H. Banks
*Assistant Examiner*—Debra Wolfe
(74) *Attorney, Agent, or Firm*—Hoffmann & Baron, LLP

(57) ABSTRACT

A tool head for use with an automatic cable tie installation system. The tool head incorporates a pawl gear mechanism which eliminates the potential for the severed excess tail portion of the tie from becoming jammed within the tensioning assembly of the tool head. Particularly, the pawl gear mechanism of the present invention includes at least one auxiliary guide ramp for contacting and positively guiding the severed tail portion into the exit chute of the tool head.

12 Claims, 11 Drawing Sheets

ANTI-JAM TENSIONING GEAR MECHANISM FOR AUTOMATIC TIE TOOL HEAD

BACKGROUND OF THE INVENTION

The present invention relates to a tool head for use with an automatic cable tie installation system and, more particularly, to an automatic tie tool head including an anti-jam tensioning gear mechanism providing improved performance and reliability.

As is well known to those skilled in the art, cable ties are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage and engages the body of the tail to secure the tail to the head.

Although cable ties are often installed manually, it is desirable in certain applications to utilize an automatic cable tie installation system wherein cable ties are dispensed from a remote dispenser, and thereafter delivered to a tool head for application about a bundle of wires positioned within the jaws of the tool head. Automatic cable ties installation systems are well-known in the art, and are disclosed for example in U.S. Pat. Nos. 6,279,620, 4,790,225, 4,498,506 and 3,946,769. It will be appreciated that the disclosed tool heads include a plurality of subassemblies each having multiple moving parts, the subassemblies cooperating together to deliver, tension and cut the cable tie. To be commercially practical, the tool head must be capable of repeatedly applying a cable tie about the bundle of articles inserted within the jaw assembly without jamming. The tool head must also be able to complete a cycle (wherein one cable tie is wrapped, tensioned and cut) within a sufficiently short interval of time.

Those skilled in the art will appreciate that prior art tool heads can experience internal jams with respect to the tensioning/strap ejection portion of the tool head. More particularly, the tail of the installed tie, once severed from the bundled wires (after tensioning of the cable tie), is directed into an exit chute whereby the excess tail portion may exit the tool head. There are times, however, when the severed tail, rather than being directed into the exit chute, is misdirected under the guide ramp defining the leading edge of the exit chute. This then squeezes the severed tail between the guide ramp (which is a fixed portion of the tool head) and the rotating tension gear, thus causing a jam within the tool head.

There is therefore a need in the art for an automatic tie tool head which is capable of repeatedly tensioning a cable tie, severing the excess tail portion from the tensioned tie, and thereafter ejecting the severed tail portion without risk of the severed tail portion becoming jammed in the tool head.

SUMMARY OF THE INVENTION

The present invention, which addresses the needs to the prior art, provides a tool head for installation of a cable tie about a bundle of elongate articles. The tool head is adapted for use with a remote dispenser, cable tie bandolier and cable tie delivery hose of an automatic cable tie installation system. The cable tie includes a head and an elongate tail extending therefrom. The tail of the tie has a width T.

The tool head includes a housing. The tool head further includes a jaw assembly for grasping and directing the cable tie about the articles. The tool head also includes a tie passage communicating at one end with the cable tie delivery hose and at the other end with the jaw assembly whereby a cable tie supplied by the remote dispenser is delivered to the jaw assembly. The tool head additionally includes a tie tensioning assembly for tensioning the cable tie. The tie tensioning assembly includes a drive train and a pawl gear mechanism.

Finally, the pawl gear mechanism includes a tension gear having at least one tail-engaging surface extending thereabout. The tail-engaging surface has a width R and defines a circumference $C_1$ having a diameter $D_1$ with respect to the center of the tension gear. The pawl gear mechanism also includes a tie guide cooperating with the tension gear to define a first passage. The tie guide includes a second passage communicating with and extending between the first passage and the housing. The first passage is sized to receive the tail of the tie from the jaw assembly upon installation of the tie about the elongate articles. The pawl gear mechanism further includes a first auxiliary ramp located adjacent the tail-engaging surface. The width T of the tail is greater than the width R of the tail-engaging surface whereby the tail contacts the first auxiliary ramp as the tail moves therepast. The first auxiliary ramp has a leading edge defining a circumference $C_2$ having a diameter $D_2$ with respect to the center of the tension gear. The diameter $D_2$ is less than the diameter $D_1$ whereby the first auxiliary ramp guides the tail from the first passage into the second passage.

As a result, the present invention provides a tool head for use with an automatic cable tie installation system with is capable of repeatedly tensioning a cable tie, severing the excess tail portion of the tension tie, and thereafter ejecting the severed tail portion without risk of the severed tail portion becoming jammed in the tool head.

DETAILED DESCRIPTION OF THE INVENTION

Figure 1:
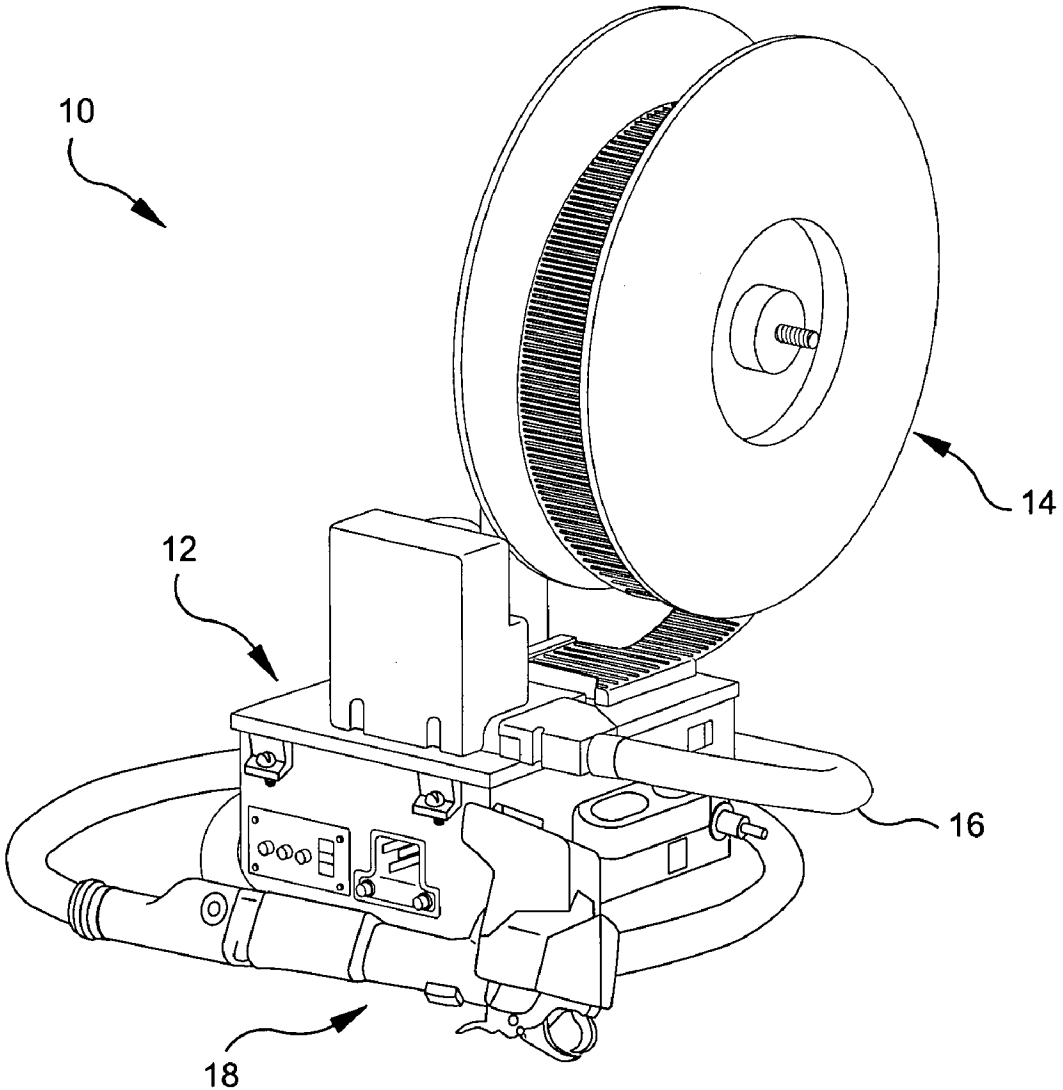
FIG. 1 Prior Art
FIG. 1 is a perspective view of a prior art automatic cable tie installation system.

Referring now to the drawings, a prior art automatic cable tie installation system 10 is shown in FIG. 1. Installation system 10 includes a cable tie dispenser 12 (as described in commonly-owned U.S. Pat. No. 6,082,577, incorporated herein by reference), a cable tie bandolier 14 (as described in commonly-owned U.S. Pat. Nos. 5,934,465 and 5,967, 316, incorporated herein by reference), a cable tie delivery hose 16 and a tool head 18. In operation, dispenser 12 severs the leading cable tie from bandolier 14, and thereafter propels the individual cable tie to the tool head via hose 16. The cable tie is wrapped about a bundle of articles positioned within the jaws, tensioned and is then subjected to a cutting operation whereby the excess tail portion of the cable tie is cut from the tensioned tie.

Figure 2:
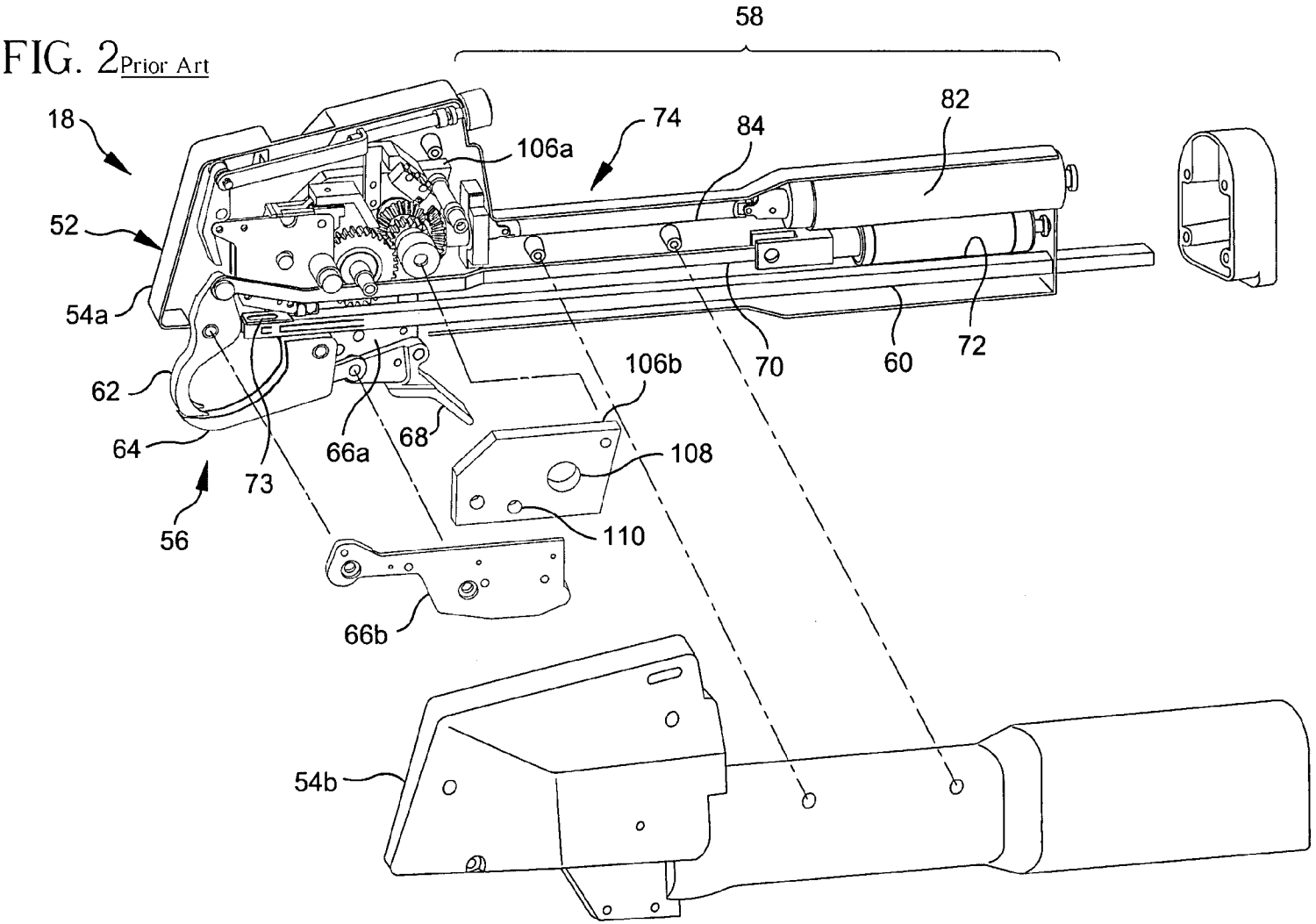
FIG. 2 Prior Art
FIG. 2 is an exploded perspective view of a prior art tool head.
Figure 2A:
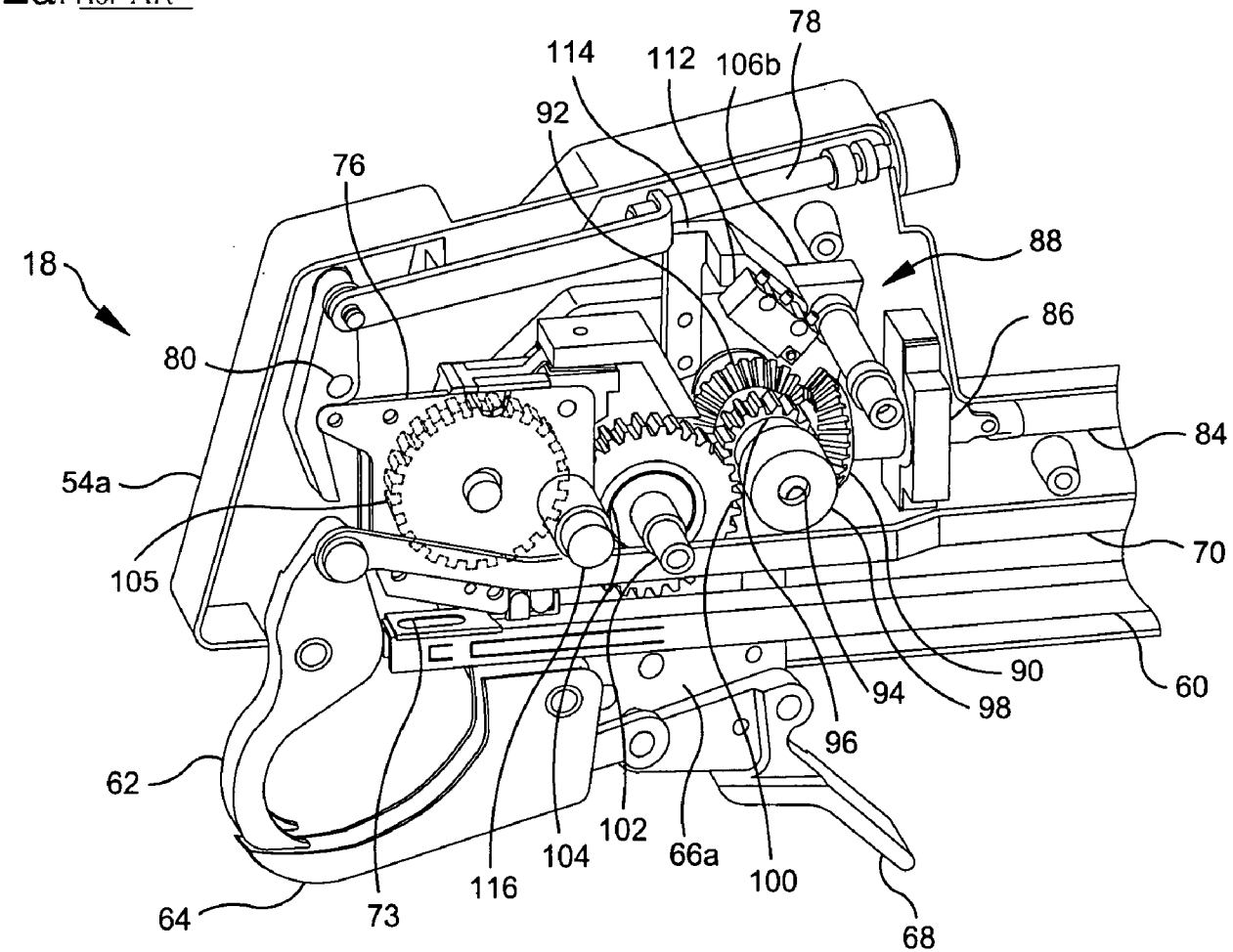
FIG. 2a Prior Art
FIG. 2*a* is an enlarged detail of FIG. 2.

The operating components of prior art tool head 18 are shown in FIGS. 2 and 2*a*. In this regard, the general operation of tool head 18 is well known to those skilled in the art. As discussed hereinabove, U.S. Pat. Nos. 6,279,620, 4,790,225, 4,498,506 and 3,946,769, all of which are incorporated herein by reference, disclose the structure and operation of various prior art tool heads.

As will be appreciated by those skilled in the art, the housing of tool head 18, i.e., housing 52, is preferably formed from first and second cooperating shells 54*a*, 54*b*. Tool head 18 also includes jaw assembly 56, tie tensioning assembly 58, and a tie passage 60 communicating at one end with cable tie delivery hose 16 and at the other end with jaw assembly 56 whereby a cable tie supplied by remote dispenser 12 is delivered to the jaw assembly.

Jaw assembly 56 includes in particular a top jaw 62, a bottom jaw 64, opposing jaw-mounting plates 66*a*, 66*b*, a trigger 68 connected to bottom jaw 64 for moving the bottom jaw between an open position and a closed position, a push rod 70 for moving top jaw 62 during installation of the cable tie about the bundle of elongate articles, a power-operated device 72 for powering said push rod, and a cutting mechanism 73 supported between jaw-mounting plates 66*a*, 66*b*.

Tie tensioning assembly 58 includes in particular a drive train 74, a pawl gear mechanism 76 and a tension adjustment mechanism 78 pivotable about a pivot point 80. Cutting mechanism 73 cooperates with pawl gear mechanism 76 to cut off the excess tail portion from the tensioned tie.

In turn, drive train 74 includes a power-operated device 82, a driveshaft 84 coupled at one end to power operated device 82, a driveshaft bearing for supporting the other end of driveshaft 84 positioned within a housing 86, and a gear assembly 88. In turn, gear assembly 88 includes a first bevel gear 90 positioned at the end of the driveshaft 84, a second bevel gear 92 fixedly coupled to a shaft 94 and located to engage first bevel gear 90, a drive gear 96 also fixedly coupled to shaft 94, a pair of opposing bearings 98 for rotatably supporting shaft 90, and an idler gear 100 rotatably coupled to a shaft 102 via a bearing 104 and located to cooperate with the pawl gear mechanism 76. As a result, rotary motion may be transmitted from driveshaft 84 to tension gear 105 (shown in hidden line in FIG. 2*a*) of pawl gear mechanism 76.

Gear assembly 88 further includes a pair of opposing gear-supporting plates 106*a*, 106*b*, for supporting the mentioned gears therebetween. In this regard, each of plates 106*a*, 106*b* includes an aperture 108 sized to receive bearings 98, and an aperture 110 sized to receive the end of shaft 102. A microswitch 112 for sensing the presence of a cable tie is mounted on a bracket 114, which in turn is secured to gear-supporting plate 106*a*. Gear-supporting plates 106*a*, 106*b* also pivotally support pawl gear cut-off mechanism 76 via a pair of pivot pins 116. Each of gear-supporting plates 106*a*, 106*b* include a pair of apertures 118 sized to receive the ends of pivot pins 116.

Figure 3:
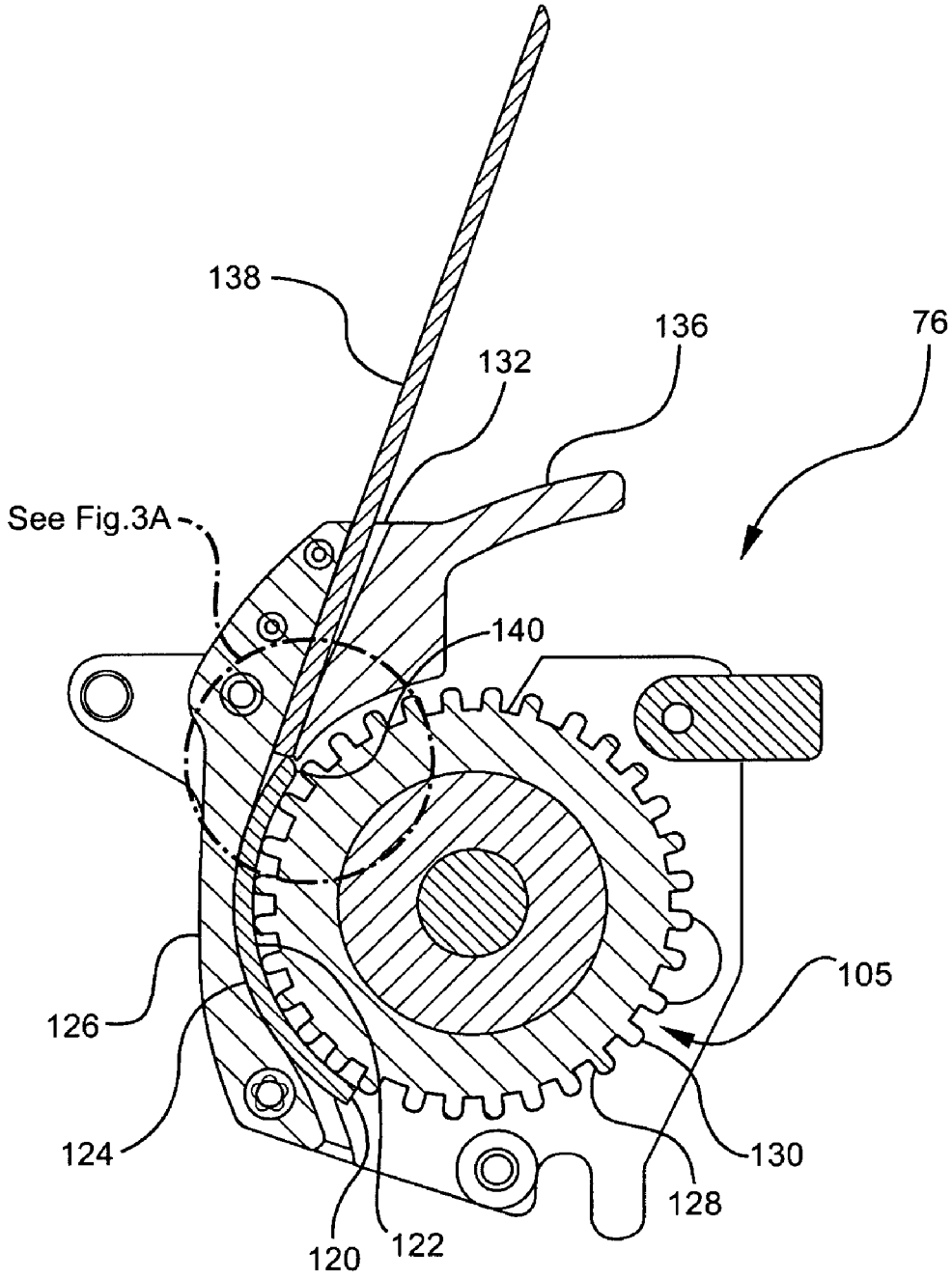
FIG. 3 Prior Art
FIG. 3 is an enlarged sectional view of a portion of the pawl gear mechanism of the prior art tool head of FIG. 2.

Prior art pawl gear mechanism 76 is shown in detail in FIG. 3. In particular, tail 120 of the cable tie which is wrapped about the bundle of articles positioned within the jaws (not shown) is captured within a first passage 122 defined between tension gear 105 and the inside surface 124 of front tie-guide 126. Tension gear 105 includes a plurality of teeth 128 extending thereabout. Each of the teeth is preferably configured to contact and engage the tail of the tie throughout first passage 122. In this regard, first passage 122 is configured such that the distance between the inside surface 124 of the front tie guide and tip 130 of one of the teeth is less than the thickness Y of tail 120.

As tension gear 105 rotates clockwise (as depicted in FIG. 3), tail 120 is pushed towards a second passage, i.e., exit chute 132. Ideally, tail 120 is directed into exit chute 132 (once it is severed from the tensioned cable tie) via ramp 134 located at the leading end of upper tie guide 136, thereby pushing the previously cut tail (i.e., tail 138) out of the tool head.

Figure 3A:
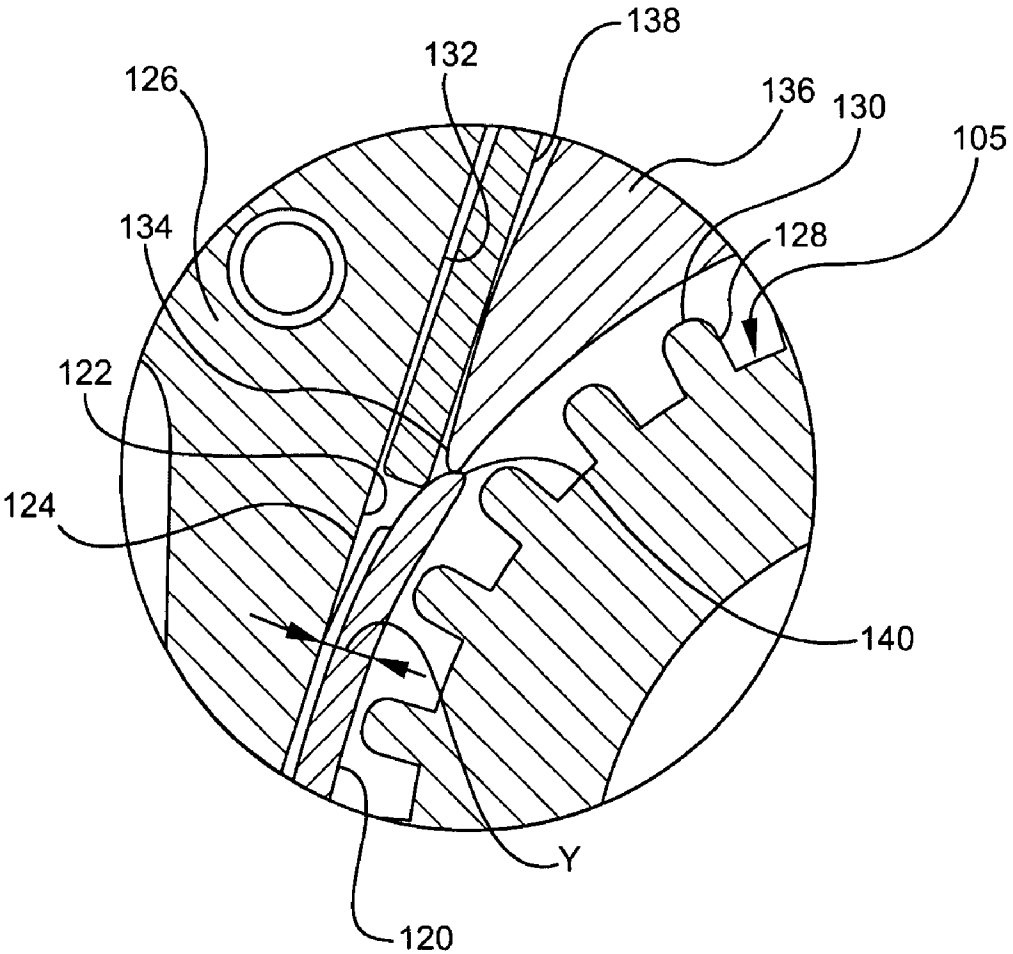
FIG. 3a Prior Art
FIG. 3*a* is an enlarged detail of FIG. 3.

However, in practice, tip 140 of tail 120 may, upon encountering the trailing end of tail 138, be misdirected under ramp 134 (see FIG. 3*a*). Although misdirection may occur when tip 140 encounters the trailing end of tail 138, it is believed that tip 140 may also be misdirected between ramp 134 and tension gear 105 due to other factors such as variations in the individual ties, tolerances of the tool head and/or waste or debris caught in the tool head.

Figure 4:
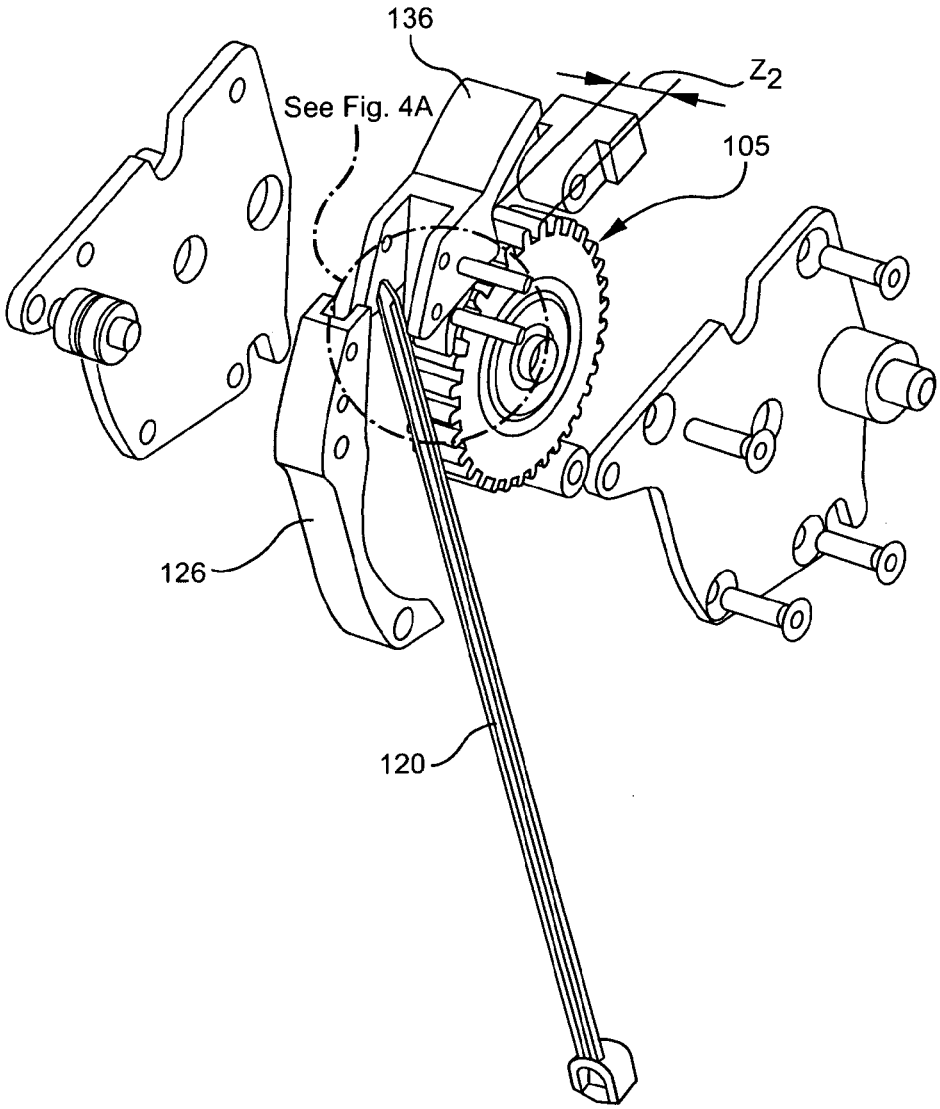
FIG. 4 Prior Art
FIG. 4 is an exploded perspective view of the pawl gear mechanism shown in FIG. 3.
Figure 4A:
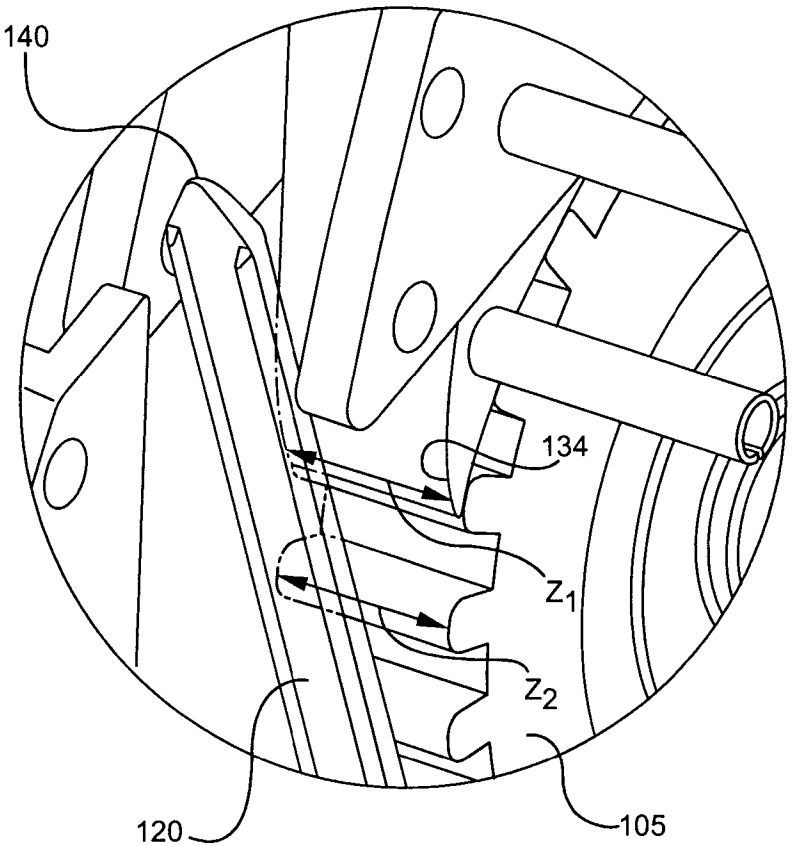
FIG. 4a Prior Art
FIG. 4*a* is an enlarged detail of FIG. 4.

As shown in FIGS. 4 and 4*a*, width $Z_1$ of prior art ramp 134 is approximately equal to width $Z_2$ of the teeth of tension gear 105. It will be appreciated that ramp 134 must be spaced a slight distance from the teeth of tension gear 105 to allow rotation of such gear. As a result, tip 140 may not always be deflected into exit chute 134 as intended. In the configuration shown in FIGS. 3–4, the teeth of tension gear 105, as well as ramp 134, are approximately 1.8 times wider than tail 120.

Figure 5:
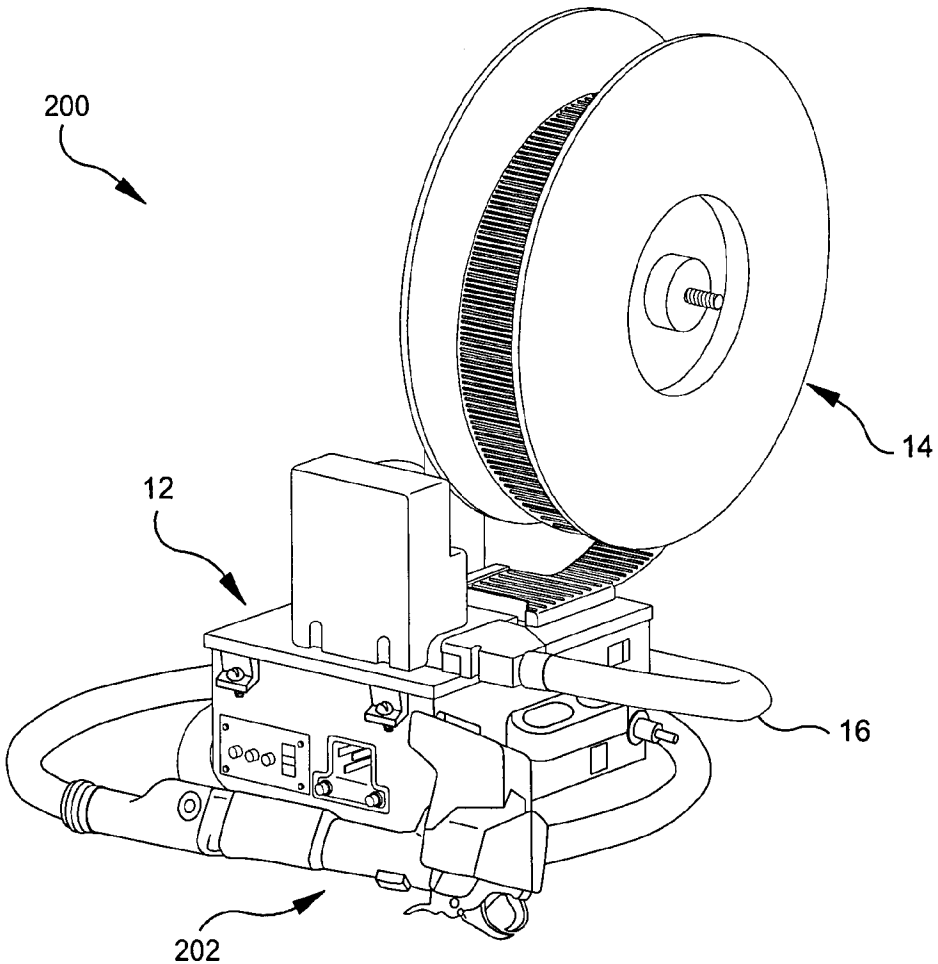
FIG. 5 is a perspective view of an automatic cable tie installation system in accordance with the present invention.
Figure 6:
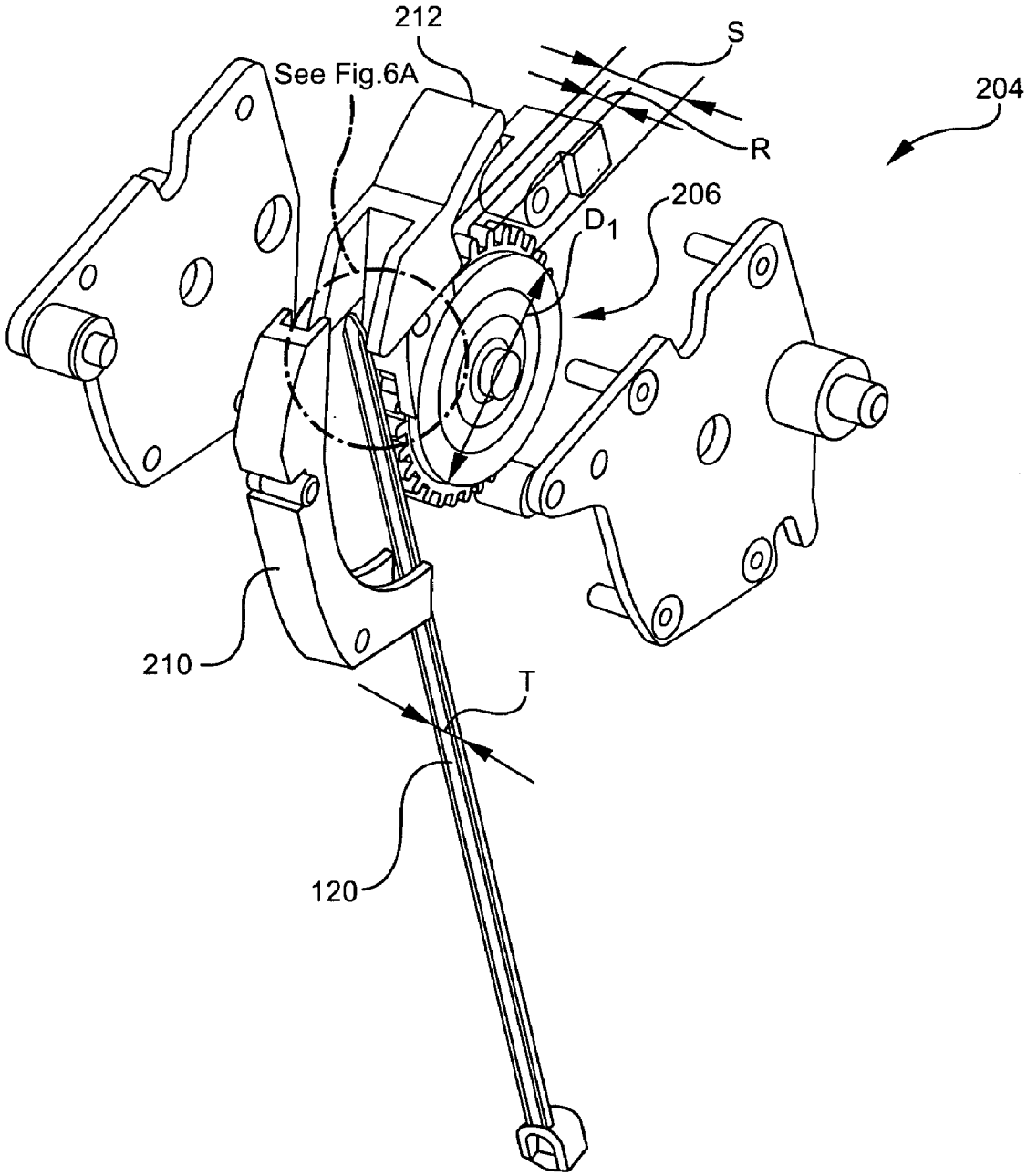
FIG. 6 is an exploded perspective view of the components of the pawl gear mechanism of the present invention.
Figure 6A:
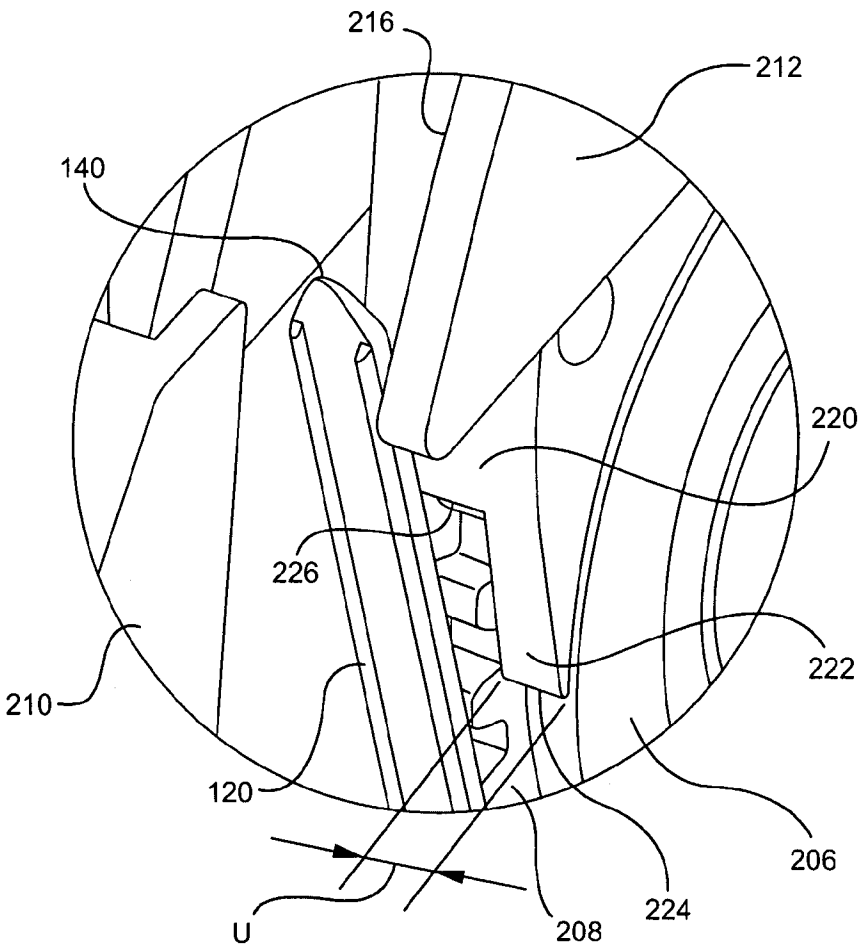
FIG. 6*a* is an enlarged detail of FIG. 6.

Referring now to FIG. 5, and as discussed hereinbelow, automatic cable tie installation system 200 of the present invention incorporates novel tool head 202. In this regard, tool head 202 incorporates and utilizes a novel pawl gear mechanism 204. In particular, pawl gear mechanism 204 includes a tension gear 206 having a tail-engaging surface, i.e., teeth 208, extending thereabout (see FIGS. 6 and 6*a*). Teeth 208 define a circumference $C_1$ having a diameter $D_1$ with respect to the center of tension gear 206.

As shown, each of teeth 208 has a width R which is less than the width S of tension gear 204. Width R of teeth 208 is preferably less than width T of tail 120. In one preferred embodiment, width R of teeth 208 is approximately 0.7 times the width T of tail 120. As a result, tail 120 overhangs teeth 208 as tail 120 is driven between teeth 208 and front tie-guide 210 during tensioning.

Pawl gear mechanism 204 further includes an upper tie-guide 212, which together with tension gear 206 and front tie guide 210, define a first passage 214 being sized to receive the tail of the tie from the jaw assembly upon installation of the tie about the elongate articles and a second passage, i.e., exit chute 216, communicating with and extending between the first passage and the housing. First passage 214 is preferably configured such that the distance between the inside surface 218 of front tie guide 210 and the engagement surfaces of teeth 208 is less than the thickness Y of tail 120. In this regard, each of the teeth is preferably configured to engage and grip the tail as it travels through the first passage.

Figure 7:
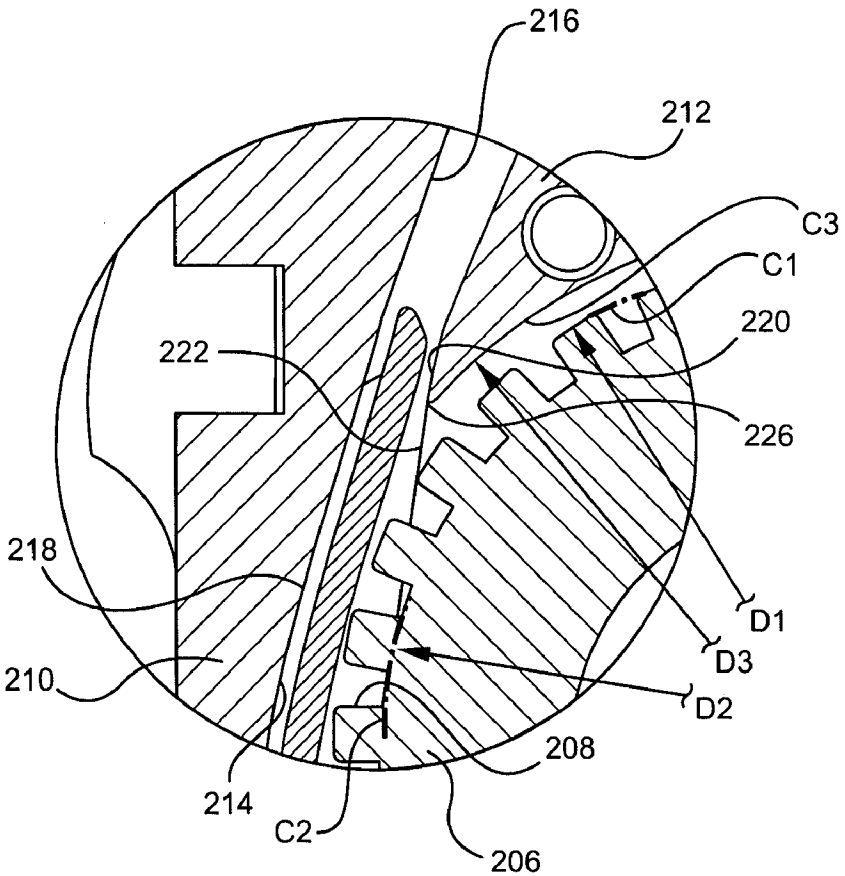
FIG. 7 is an enlarged sectional view of a portion of the pawl gear mechanism of the present invention.

Upper tie guide 212 includes a main ramp 220 and at least one, and preferably a pair, of auxiliary guide ramps 222 positioned on opposing sides of teeth 208. Each of the auxiliary guide ramps preferably has a width U. In one preferred embodiment, the width T of tail 120 is substantially equal to the sum of width R of teeth 208 and widths U of the auxiliary ramps. As best shown in FIG. 7, auxiliary guide ramps 222 extend away from and radially inward of main guide ramp 220, i.e., through a location inside of diameter $D_1$ defined by the circumference of teeth 208. In particular, leading edges 224 of auxiliary guide ramps 222 define a circumference $C_2$ having a diameter $D_2$ with respect to the center of tension gear 206, $D_2$ being less than $D_1$.

Main ramp 220 is preferably located to define the intersection of the first and second passages. Main ramp 220 includes a leading edge 226 which defines a circumference $C_3$ having a diameter $D_3$ with respect to the center of tension gear 206. In one preferred embodiment, auxiliary guide ramps 222 extend continuously from diameter $D_2$ to diameter $D_3$. As a result, tail 120 (which is wider than gear teeth 208) will initially contact auxiliary guide ramps 222 and be directed onto main guide ramp 220. Thus, the auxiliary ramps continuously and positively deflect the tail away from the tension gear and onto the main ramp defining the entrance of the exit chute. Of course, it is contemplated herein that auxiliary guide ramps may be discontinuous from main ramp 220 or upper tie guide 212 as long as such auxiliary guide ramps are located approximately along diameter $D_1$ and are configured to direct the tail into the exit chute.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the following claims.

What is claimed is:

1. A tool head for installation of a cable tie about a bundle of elongate articles, the tool head being adapted for use with a remote dispenser, cable tie bandolier and cable tie delivery hose of an automatic cable tie installation system, said cable tie including a head and an elongate tail extending therefrom, said tail having a width T, the tool head comprising:

a housing;

a jaw assembly for grasping and directing said cable tie about said articles;

a tie passage communicating at one end with said cable tie delivery hose and at the other end with said jaw assembly whereby a cable tie supplied by said remote dispenser is delivered to said jaw assembly;

a tie tensioning assembly for tensioning said cable tie, said tie tensioning assembly including a drive train and a pawl gear mechanism; and wherein said pawl gear mechanism includes a tension gear having at least one tail-engaging surface extending thereabout, said tail-engaging surface having a width R and defining a circumference $C_1$ having a diameter $D_1$ with respect to the center of said tension gear, said pawl gear mechanism also including a tie guide cooperating with said tension gear to define a first passage, said tie guide including a second passage communicating with and extending between said first passage and said housing, said first passage being sized to receive said tail of said tie from said jaw assembly upon installation of said tie about said elongate articles, said pawl gear mechanism further including a first auxiliary ramp located adjacent said tail-engaging surface, and wherein said width T of said tail is greater than said width R of said tail-engaging surface whereby said tail contacts said first auxiliary ramp as said tail moves therepast, and wherein said first auxiliary ramp has a leading edge defining a circumference $C_2$ having a diameter $D_2$ with respect to the center of said tension gear, and wherein said diameter $D_2$ is less than said diameter $D_1$ whereby said first auxiliary ramp guides said tail from said first passage into said second passage.

2. The tool head according to claim 1, further comprising a second auxiliary ramp, said second auxiliary ramp being located adjacent said tail-engaging surface and opposite said first auxiliary ramp.

3. The tool head according to claim 2, wherein each of said first and second auxiliary ramps has a width U, and wherein said width T of said tail is substantially equal to the sum of width R of said tail-engaging surface and widths U of said first and second auxiliary ramps.

4. The tool head according to claim 3, wherein said tie guide includes a main ramp having a leading edge defining a circumference $C_3$ having a diameter $D_3$ with respect to the center of said tension gear.

5. The tool head according to claim 4, wherein said diameter $D_3$ of said leading edge of said main ramp is greater than said diameter $D_1$ of said tail-engaging surface.

6. The tool head according to claim 5, wherein said second auxiliary ramp includes a leading edge defining a circumference $C_4$ having a diameter $D_4$ with respect to the center of said tension gear, and wherein $D_4$ is substantially equal to $D_2$.

7. The tool head according to claim 6, wherein said tail-engaging surface includes a plurality of external gear teeth, each of said teeth being configured to engage and grip said tail throughout said first passage.

8. The tool head according to claim 7, wherein said main ramp is located to define the intersection of said first and second passages.

9. The tool head according to claim 8, wherein said tie guide includes a front tie guide and an upper tie guide, said front tie guide and said tension gear cooperating to define said first passage, said second passage being located between said front and upper tie guides, said main ramp being located on said upper tie guide.

10. The tool head according to claim 9, wherein said auxiliary guide ramps are located on said upper tie guide, and wherein said auxiliary guide ramps extend continuously from diameter $D_2$ to diameter $D_3$ whereby said tail is continuously and positively guided from said first passage onto said main ramp defining said second passage.

11. The tool head according to claim 10, wherein said tensioning assembly further includes a tension adjustment mechanism pivotally mounted to said housing and located to cooperate with said pawl gear mechanism.

12. The tool head according to claim 11, wherein said jaw assembly includes:

top and bottom jaw members;

first and second opposing jaw-mounting plates;

a trigger connected to said bottom jaw for moving said bottom jaw between an open position and a closed position;

a push rod for moving said top jaw during installation of said cable tie about said bundle of elongate articles;

a power-operated device for powering said push rod; and a cutting mechanism supported between said jaw-mounting plates and cooperating with said pawl gear mechanism to cut off an excess portion of said tail from said tensioned cable tie.

* * * * *